US010473443B1

(12) United States Patent
Gent

(10) Patent No.: US 10,473,443 B1
(45) Date of Patent: Nov. 12, 2019

(54) CASE HONE

(71) Applicant: Jeffrey Howard Gent, Brownsville, OR (US)

(72) Inventor: Jeffrey Howard Gent, Brownsville, OR (US)

( * ) Notice: Subject to any disclaimer, the term of this patent is extended or adjusted under 35 U.S.C. 154(b) by 0 days.

(21) Appl. No.: 16/371,025

(22) Filed: Mar. 31, 2019

(51) Int. Cl.
*B21K 21/04* (2006.01)
*F42B 33/00* (2006.01)

(52) U.S. Cl.
CPC ..... *F42B 33/00* (2013.01)

(58) Field of Classification Search
CPC ..... F42B 33/00; F42B 33/001; F42B 33/002; F42B 33/10; F42B 33/14; B23P 15/22; B21D 51/54; B21K 21/04
See application file for complete search history.

(56) References Cited

U.S. PATENT DOCUMENTS 2,741,148 A * 4/1956 Thompson, Jr. ..... F42B 33/10 86/23
3,174,390 A * 3/1965 Jacobsen ..... F42B 35/02 86/24
3,266,075 A * 8/1966 Conrad ..... F42B 33/06 15/104.03
5,727,295 A * 3/1998 Gracey ..... B21K 21/04 82/113
5,788,429 A * 8/1998 Gracey ..... B23B 5/168 408/234
6,101,915 A * 8/2000 Sinclair ..... F42B 33/10 409/140
6,192,561 B1 * 2/2001 Bennett ..... B21D 41/04 72/118
6,484,616 B1 * 11/2002 Giraud ..... B23P 23/02 86/19.5
7,155,789 B1 * 1/2007 Gracey ..... B23B 5/165 29/33 T
9,970,741 B1 * 5/2018 Eldredge ..... B23B 5/16

* cited by examiner

*Primary Examiner* — Gabriel J. Klein

(57) ABSTRACT

A tube with a conical mouth slides over the neck of an ammunition cartridge and is pressed against the shoulder to align the case. A neck reamer translates and rotates within the tube, the tip being inserted into the neck. Both mouth and tip are replaceable, come in different sizes, and come with smooth or abrading surfaces. The tip and the mouth are coaxial. The mouth perfects the shoulder surface and the tip perfects the neck interior. This results in a cartridge case having a neck with an interior wall that is a perfect cylinder that is coaxial with the perfected exterior of the conical shoulder.

2 Claims, 2 Drawing Sheets

CASE HONE

CROSS-REFERENCE TO RELATED APPLICATIONS

Not Applicable

BACKGROUND OF THE INVENTION

This invention pertains to the making of ammunition cartridges for rifles such as those used by hunters, military, and competitive shooters.

Rifle chamber and ammunition cartridge designations are standardized by the Sporting Arms and Ammunition Manufacturer's Institute (SAAMI). ANSI maintains a corresponding standard Z299.4. These standards define, among other things, the physical dimensions of the cartridge and chamber for each cartridge designation by way of a mechanical drawing specifying the dimensions and tolerances for each feature. These dimensions and tolerances dictate how the cartridge will fit into the chamber, take into account changes in the cartridge dimensions during firing, and also account for normal manufacturing variation to ensure that all commercial ammunition will function in all commercial rifles.

Allowable variations are small but they can have a significant effect on accuracy because they may alter the way a bullet enters the barrel; which affects how it leaves the barrel; which affects downrange accuracy. One of the motivations for hand loading ammunition is to take advantage of the ability to adjust the final dimensions of the cartridge to closely match the chamber of a particular rifle and to also decrease the variation from cartridge to cartridge; thereby increasing accuracy and consistency. Among other things, careful loaders are concerned with the concentricity of the bullet to the bore of the barrel.

Any lack of concentricity between the bullet and the bore will cause the center of mass of the bullet to rotate about the central axis of the bore as the bullet moves down the barrel. Once the bullet is in flight the center of mass will continue to rotate about the center of rotation; which results in wobbling during flight; which has an appreciable deleterious effect on downrange accuracy. Shooters have been aware of this for a long time, so careful hand loaders have long used a variety of tools and techniques to reform the cartridge case in an effort to eliminate any lack of concentricity. However, those tools and techniques were developed based on a theory of operation that is only properly applied to a subset of rifle cartridge types.

Ammunition cartridges are assembled from a case, a primer, powder, and a bullet and are put into several broad classes based on the type of case that is used: rimmed, rimless, and belted being the most common types. Each of these three types of cases use a different physical feature on the case to locate the case inside the chamber, which is commonly called 'headspacing' but within the SAAMI specification is called 'breeching'. Rimmed and belted cases are breeched by ("headspace off of" is the common terminology) the rim or belt, both features being located at the head of the case (end opposite the bullet). Rimless cases are breeched by ("headspace off of") the shoulder, the conical transition between the larger cylindrical body of the case; which holds the powder; and the smaller cylindrical neck; which holds the bullet. This is a difference that the prior art has not addressed. All of the different reloading dies, overall-length-gauges, bullet comparators, other tools, and the techniques for using them that are contained in the prior art and commercially available make no differentiation between these different case types, essentially treating all of them as if they were of the rimmed type; where all critical dimensions are referenced from the head of the case and alignment is controlled by adjustments to the body and neck of the case. However, for rimless shoulder breeching cartridges critical dimensions are properly referenced to the case shoulder and it is the case shoulder that should be used to align the bullet.

This is a critical distinction that is being ignored by the existing technology; so I have designed a set of tools for loading cartridges that are similar to existing tools but are designed specifically for rimless shoulder breeching rifle cartridges. These include tools for measuring the chamber and ammunition properly, a case trimmer, a neck sizing die, and a bullet seating die, each of which is the subject of a separate invention disclosure. This disclosure is for a tool similar to a case trimmer.

BRIEF SUMMARY OF THE INVENTION

Among the tools that hand loaders use are those that are called case trimmers, neck lathes, or neck shavers. These are tools that cut the end of the neck to reduce the overall length; some also remove material from the outside of the neck in an effort to ensure that the axis of the bullet is coaxial with the axis of the bore of the barrel when the cartridge is sitting in the chamber. This is typically done after the case has been resized in preparation for use of a bullet seater to insert a bullet.

The tool design herein disclosed performs the same functions as these case trimmers and neck shavers but it relies upon the shoulder instead of the body to align and locate the case and it prepares the inside of the neck, not the outside. The preferred embodiment is a bench top mounted frame holding a hollow shaft with a conical mouth that is pressed against the shoulder to align the cartridge case; then a second shaft slides and rotates within the hollow shaft with a tip that hones the inside of the neck of the case and trims the length of the neck. The conical mouth in the hollow shaft can also be used to perfect the outer surface of the shoulder. A slip fitment of inner shaft to outer shaft ensures that the tip of the inner shaft remains coaxial with the conical mouth of the outer shaft. This ensures that the inner surface of the neck is formed coaxial with the outer shoulder of the case.

This unique result ensures that the case will hold the bullet in a position inside the chamber where it is coaxial with the bore of the barrel. This is true for shoulder breeching cartridges only. Rimmed and belted cartridges could be processed in this tool but the result would not be the same because they locate the bullet using the body instead of the shoulder.

BRIEF DESCRIPTION OF THE SEVERAL VIEWS OF THE DRAWING

FIG. 1 illustrates, with an exploded view, the preferred embodiment of the case hone, which is a bench top mounted hand-operated device made of steel and brass, or similar materials. Critical dimensions will change to match the cartridge the hone is designed for.

DETAILED DESCRIPTION OF THE INVENTION

Figure 1:
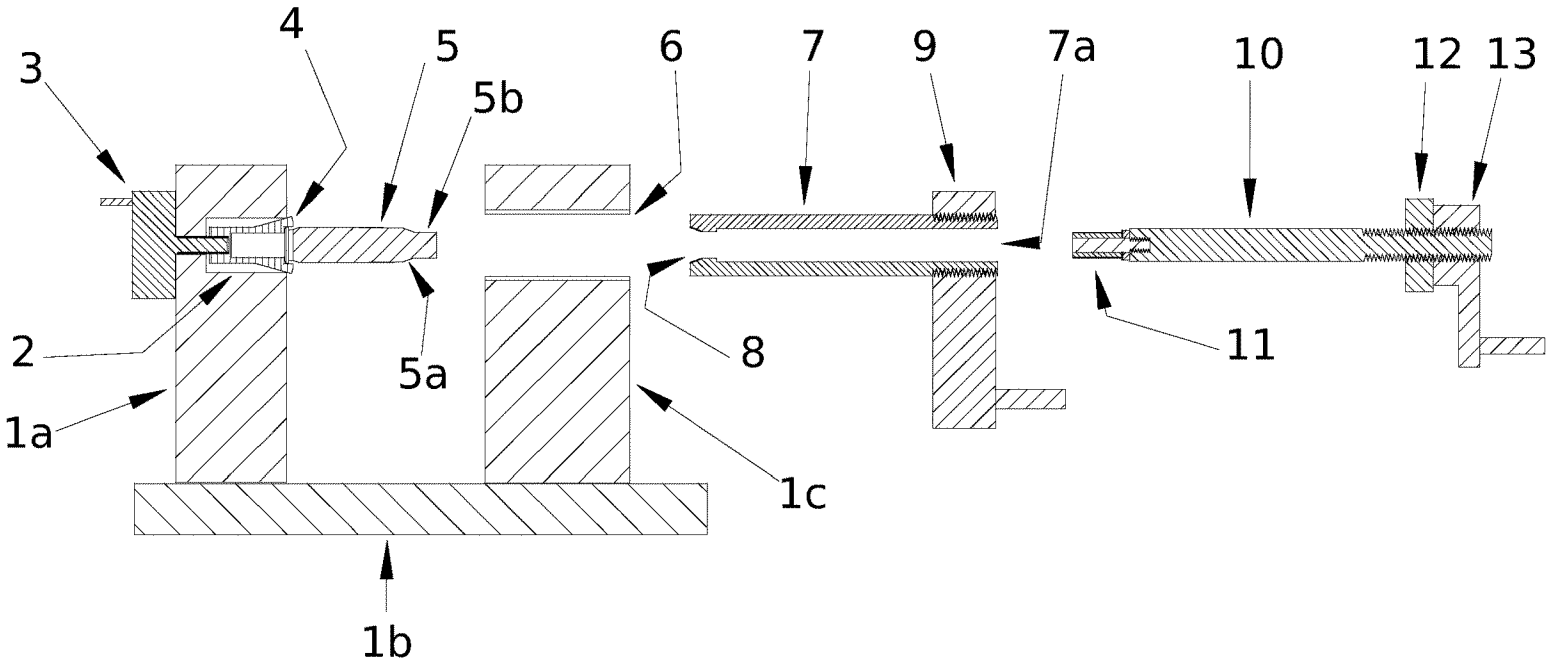

Disclosed is a novel design for a tool that prepares rimless shoulder breeching rifle cartridge cases for loading. The objective of this invention is improved concentricity of the bullet to the barrel bore in order to reduce in-flight wobble and thereby improve downrange accuracy. Similar tools are called trimmers but I call this tool a hone because it functions primarily by removing a very small amount of material from the shoulder exterior and the neck interior, producing thereby a smooth perfectly shaped shoulder exterior and neck interior.

The tool is used in the following manner.

1) Secure the base of the frame (1*b*) to a table or bench top.
2) Insert a collet (4) sized for the case (5) into the mounting hole (2) in the head block (la) and secure it with the collet screw (3), but do not tighten.
3) Select the proper size and type of shoulder hone (7) for the case (5) and the operation to perform. The mouth (8) of the shoulder hone (7) is a conical surface, the cone angle and nominal diameter must match the conical shoulder (5*a*) of the cartridge case (5). The mouth (8) is available in two types: a hone, which has a mildly abrasive surface; and a pilot, which has a smooth surface.
4) Insert the case (5) into the collet (4).
5) Insert the shoulder hone (7) into the bushing (6) in the tail block (1*c*) until the mouth (8) is pressing against the shoulder (5*a*) of the case (5), which aligns the case, and tighten the collet screw (3).
6) If the mouth (8) is an abrasive type, rotate the shoulder hone (7) with the shoulder hone handle (9) while maintaining gentle pressure against the case, removing only enough material from the shoulder as is necessary to perfect the surface of the case shoulder (5*a*). Removing too much material will weaken the case (5), producing a potentially dangerous situation, so this operation will not always be performed. The primary purpose of the mouth (8) is to align the case (5) for the following operations so a smooth surfaced pilot type of mouth (8) can be used align the case (5) while avoiding removing material from the shoulder (5*a*) (this presumes the shoulder is already well formed).
7) Choose the appropriate size and type of reamer tip (11), which is a cylinder with an outer working surface. The diameter must match the interior of the case neck (5*b*). The types are: reamer, pilot, reamer and trimmer, pilot and trimmer. The reamer type has a mildly abrasive working surface ((11*a*) of FIG. 3) that removes material from the interior surface of the neck (5*b*). The pilot type has a smooth surface so that it does not remove material but only functions as an alignment feature. The reamer and trimmer type includes radially oriented cutters ((11*b*) of FIG. 3) that removes material from the interior and then also shaves the end of the neck (5*b*) to shorten it. The pilot and trimmer type has a tip with a smooth cylinder and radially oriented cutters (11*b*) that only shave the end of the neck (5*b*).
8) Attach the reamer tip (11) to the reamer shaft (10). Then insert the shaft (10) into the bore of the shoulder hone (7*a*) until contact is made with the neck (5*b*).
9) While ensuring that the mouth (8) remains pressed against the case shoulder (5*a*), maintaining alignment, rotate the reamer handle (13) while slowly pressing the reamer into the neck (5*b*). If the tip (11) is the reamer only type it is inserted until it stops on the end of the neck. If the tip includes a trimmer (11*b*) then it is inserted until the lock ring (12) is pressed against the rear of the shoulder hone. The lock ring (12) and handle (13) are threaded onto the reamer shaft (10) and adjusted to set the length the neck (5*b*) is trimmed to.
10) Retract the shoulder hone (7) and reamer shaft (10), loosen the collet screw (3), then remove the case (5) and inspect.

The result of the above operations will be a case (5) with a shoulder (5*a*) having an exterior surface that has been machined to a perfect truncated cone and a neck (5*b*) having an interior surface that has been machined to a perfect cylinder that is coaxial with the shoulder (5*a*). When a cartridge is assembled from a case (5) thus prepared the axis of the bullet will be perfectly coaxial with the shoulder (5*a*). When that cartridge is of the shoulder breeching type it will therefore, when inserted into a rifle chamber, position the bullet perfectly coaxial with the bore of the barrel. Therefore, upon firing the bullet will rotate about its center of mass and, therefore, in-flight wobble will be greatly reduced.

This result is achieved because of the unique arrangement of the elements of the design, but careful manufacturing is required to realize it. The collet (4) is coaxial with the bushing (6) in the tail block (1*c*). There is a slip fit between the shoulder hone (7) and the bushing (6). The conical mouth (8) is coaxial with the outer cylindrical surface of the shoulder hone (7) and has a cone angle and nominal diameter that matches the conical shoulder (5*a*) of the case (5). It is the compressive force between the two matching conical surfaces, the mouth (8) and the shoulder (5*a*), that aligns the case (5). Maintaining this compressive force is essential to maintaining alignment. The bore in the shoulder hone (7*a*) is also coaxial with the outer surface and the mouth (8). There is a slip fit between the reamer shaft (10) and the bore in the shoulder hone (7*a*). The cylindrical working surface of the reamer tip (11*a*) is coaxial with the cylindrical outer surface of the reamer shaft (10). Therefore, the working surface of the reamer tip (11*a*) will be coaxial with the case shoulder (5*a*) throughout the operation of the tool.

Figure 2:
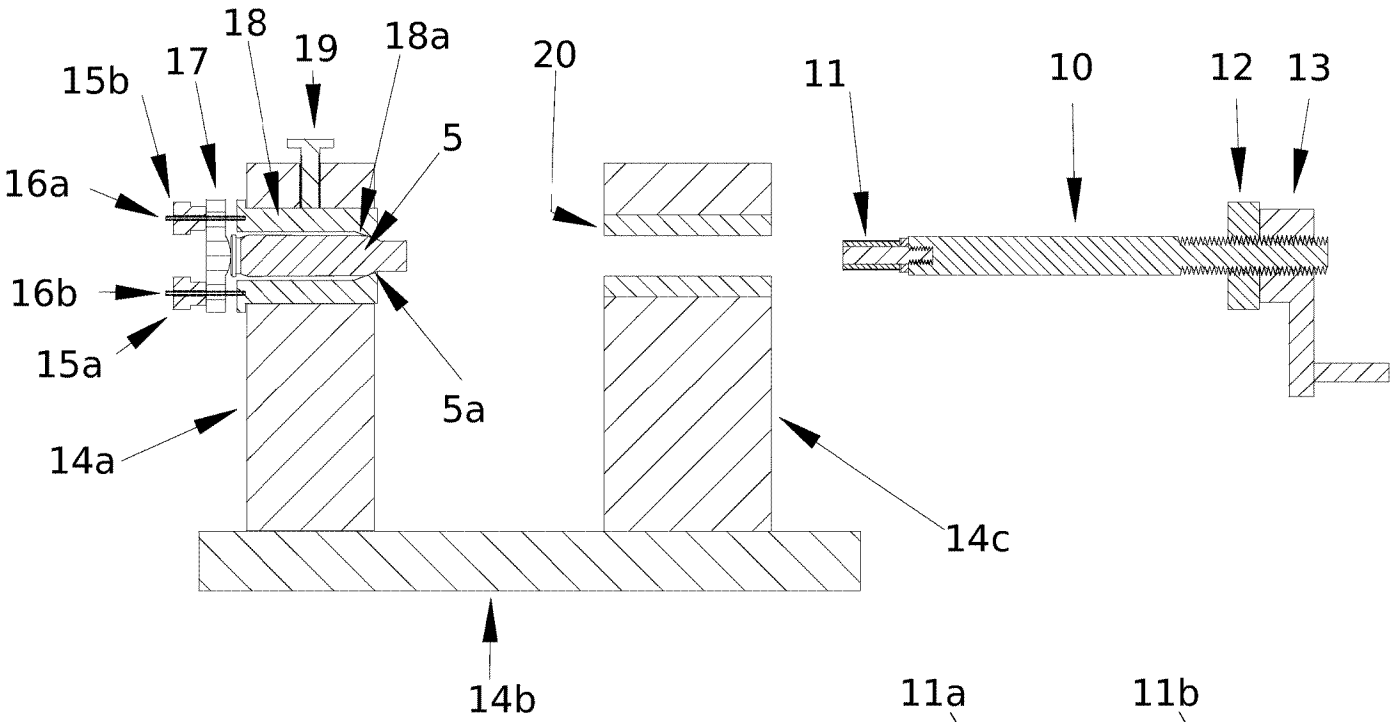
FIG. 2 illustrates, with an exploded view, alternative embodiments of various elements of the case hone.

FIG. 2 illustrates an alternative embodiment of the case hone. This embodiment does not work the shoulder of the case (5*a*). The alignment function of the mouth (8) has been moved to an alignment bushing (18) housed in a modified head stock (14*a*), which has a bore ending in a conical cup (18*a*) with a cone angle and nominal diameter that matches the case shoulder (5*a*). A thumb screw (19) retains the alignment bushing (18) in the head stock (14*a*). Two thumb nuts ((15*a*) and (15*b*)) turn on threaded shafts ((16*a*) and (16*b*)) to press a retaining cap (17) against the head of the case (5) to generate the compressive force between the shoulder (5*a*) and the conical cup (18*a*) necessary to achieve and maintain alignment of the case (5). A modified tail stock (14*c*) holds a modified bushing (20) with an inner diameter that matches the reamer shaft (10). The conical cup (18*a*) is coaxial with the tail stock bushing (20) which ensures that the reamer tip (11) is coaxial with the case shoulder (5*a*).

Figure 3:
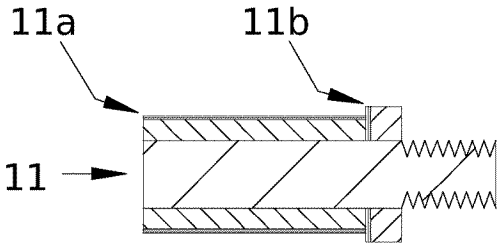
FIG. 3 is a detail view of the reamer tip illustrated in FIGS. 1 and 2.

FIG. 3 is an enlarged view of the reamer tip (11) illustrating the reamer working surface (11*a*) and trimmer (11*a*) option discussed above.

I claim:

1. An apparatus for honing an ammunition cartridge case, said case comprising a conical shoulder and a cylindrical neck, said apparatus comprising:

a shoulder-hone comprising a bore, said bore terminating with a conical mouth, an axis of said mouth being co-axial with an axis of said bore, said mouth having a cone angle and median diameter substantially equal to the cone angle and median diameter of said shoulder of said case, said mouth of said shoulder-hone being pressed against said shoulder of said case during operation of said apparatus;

the surface of said mouth of said shoulder-hone being either smooth, cutting, or abrading;

said mouth of said shoulder-hone being incorporated into, fixedly attached, or removably attached to said shoulder-hone;

neck-reamer comprising a shaft and a tip, said shaft translating and rotating within said bore of said shoulder-hone during operation of said apparatus, said tip comprising a cylindrical working surface, an axis of said working surface of said tip being co-axial with an axis of said shaft of said neck-reamer;

said working surface of said tip of said neck-reamer being either smooth, cutting, or abrading;

said tip of said neck-reamer being incorporated into, fixedly attached, or removably attached to said neck-reamer.

2. An apparatus according to claim 1 further comprising a means for trimming the end of said neck of said case, said means including one or more radially oriented cutting blades incorporated into said tip of said neck-reamer.

* * * * *